US006572404B1

(12) United States Patent
Wu

(10) Patent No.: US 6,572,404 B1
(45) Date of Patent: Jun. 3, 2003

(54) BOARD LOCK FOR ELECTRICAL CONNECTOR

(75) Inventor: Jerry Wu, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/191,637

(22) Filed: Jul. 8, 2002

(51) Int. Cl.[7] ..... H01R 13/73
(52) U.S. Cl. ..... 439/567; 439/79
(58) Field of Search ..... 439/567, 79, 733.1

(56) References Cited

U.S. PATENT DOCUMENTS 4,681,389 A * 7/1987 Nakazawa et al. ..... 439/557
5,468,154 A * 11/1995 Yip et al. ..... 439/79
5,827,089 A 10/1998 Beck, Jr.
6,012,931 A * 1/2000 Michaux et al. ..... 439/79
6,257,925 B1 7/2001 Jones
6,280,255 B1 * 8/2001 Wu et al. ..... 439/660
6,454,599 B1 * 9/2002 Wu ..... 439/567

* cited by examiner

*Primary Examiner*—Tho D. Ta
(74) *Attorney, Agent, or Firm*—Wei Te Chung

(57) ABSTRACT

A board lock (1) for holding an electrical connector (2) to a PCB (3) comprises a body section (11). The body section has a first end (12) and a second end (13). The first end has a connector engaging portion (121) for engaging with the connector. The second end has a pair of legs (14) extending downwardly therefrom and adapted to extend into the PCB, and an additional beam (15) extending downwardly therefrom adapted for abutting against an edge of the PCB. Each of the legs has an outer edge (142) and a latch portion (141) extending laterally from the outer edge adapted to latch to a bottom surface of the PCB. The additional beam also has a latch portion (151) extending laterally toward the legs for latching with the bottom surface of the PCB.

12 Claims, 6 Drawing Sheets

BOARD LOCK FOR ELECTRICAL CONNECTOR

BACKGROUND OF THE INVENTION

1. Field of the Invention

The present invention relates to a board lock for locking or securing two components, such as an electrical connector and a printed circuit board (PCB) together.

2. Description of Related Art

Electrical connectors always should be mounted on PCBs to electrically connect with other electrical elements. Generally, the electrical connectors have mounting devices, such like board locks for securing the electrical connectors to the PCBs. Referring to FIG. 7 of the present application, a board lock 6 is received in a housing 5 of an electrical connector and mounted on a PCB7. The board lock 6 has a body portion 63 engaging with the housing 5 and a pair of legs 61 extending downwardly from the body portion 63. The two legs 61 each have an outwardly extending barb 62. The legs run through a through hole 71 defined in the PCB7 and the barbs 62 abut against a bottom surface 72 of the PCB7. Thus, the board lock 6 locks the housing 5 of the connector on the PCB7.

However, when a distance D from a mating face of the connector to the leg 61 is long, the connector is likely to rotate relative to the PCB 7 about direction A when the connector is subject to a mating force from a mated complementary connector. The rotation adversely affects the soldering joints (hence the electrical connections) between the connector and the PCB 7.

To solve the problem mentioned above, U.S. patent application Ser. No. 09/938,442 invented by the same inventor and assigned to the same assignee of the instant invention, discloses an improved board lock having two pairs of legs extending downwardly from the body section of the board lock. The two pairs of legs are received in two corresponding through holes of the PCB to prevent the connector from rotating when the connector is mated with a complementary connector. However, the design of the two pairs of legs is relatively complex and the PCB must be provided with more through holes. Hence, a further improved board lock is required to overcome the disadvantages of the conventional board locks.

SUMMARY OF THE INVENTION

It is an objective of the present invention to provide a board lock for preventing an electrical connector from rotating relative to a PCB on which the electrical connector is mounted, when the connector is subject to a push force coming from a mated complementary connector.

In order to achieve the object above-mentioned, a board lock in accordance with the present invention for holding an electrical connector to a PCB comprises a body section. The body section has a first end and a second end. The first end has a connector engaging portion for engaging into the connector. The second end has a pair of legs extending downwardly therefrom and adapted to extend into the PCB, and an additional beam extending downwardly therefrom adapted for abutting against an edge of the PCB. Each of the legs has an outer edge and a latch portion extending laterally from the outer edge adapted to latch to a bottom surface of the PCB. The additional beam also has a latch portion extending laterally toward the legs and adapted to latch the bottom surface of the PCB.

Other objects, advantages and novel features of the invention will become more apparent from the following detailed description when taken in conjunction with the accompanying drawings.

DETAILED DESCRIPTION OF THE INVENTION

Figure 1:
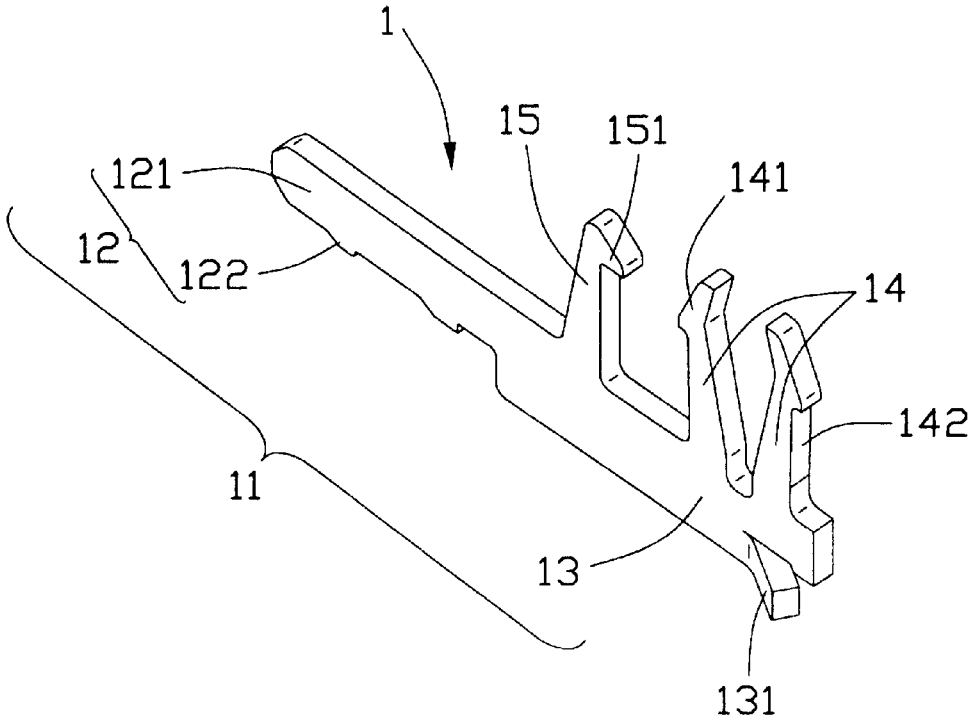
FIG. 1 is a perspective view of a board lock in accordance with the present invention.

In order to clearly show the connection between a board lock 1 of the present invention and a PCB 3, the board lock 1, an electrical connector 2 incorporating the board lock 1 and the PCB 3 are shown upside down in the drawings. Positional modifiers used through the following description to indicate the relative position of the elements of the present invention are accorded with their actual positions, rather than those shown in the drawings.

Referring to FIGS. 1–4, the board lock 1 for holding the electrical connector 2 to a PCB 3 comprises a body section 11. The body section 11 has a first end 12 and a second end 13. The first end 12 has a connector engaging portion 121 and two barbs 122 formed on a top edge thereof. The second end 13 has a pair of legs 14 and an additional beam 15 extending downwardly therefrom. Each of said legs 14 has an outer edge 142. The outer edges are opposite to each other. A latch portion 141 extends laterally from each outer edge 142. The additional beam 15 also has a latch portion 151 extending laterally toward the legs 14. The second end 13 further has an inclined tab 131 formed on an upper portion thereof and projecting sideward.

Figure 2:
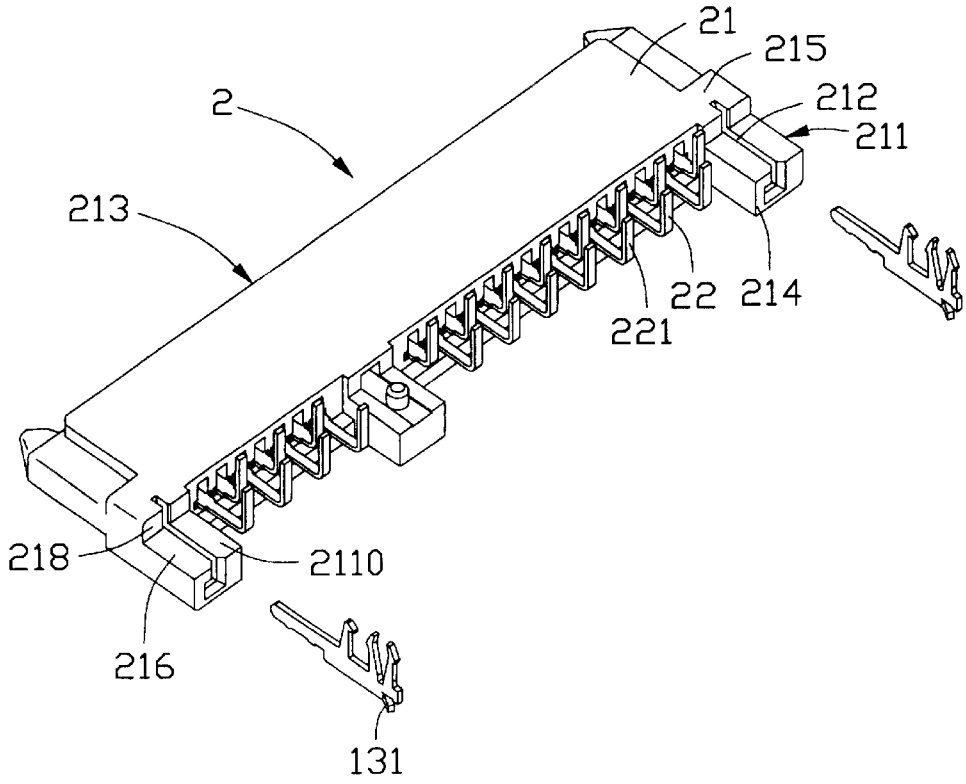
FIG. 2 is a perspective view of an electrical connector to which a pair of the board lock shown in FIG. 1 is to be assembled.

Particularly referring to FIG. 2, the electrical connector 2 comprises an insulative housing 21 and a plurality of terminals 22 received in the insulative housing 21. The insulative housing 21 comprises a pair of side sections 211 on opposite sides thereof. The side sections 211 each define a cutout 216 in a rear portion of a lower surface 215 thereof. Each cutout 216 extends from a rear face 214 forwardly to a connection surface 218 of a corresponding side section 211. Each side section 211 has a bottom surface 2110 and the connection surface 218 vertically connects the bottom surface 2110 with the lower surface 215. Each side section 211 defines a slit 212 from the rear face 214 toward a mating face 213 of the electrical connector 2. Each slit 212 comprises first and second parts 2121, 2122 (shown in FIG. 5). The first part 2121 of the slit 212 is defined in an interior of the side sections 211 and the second part 2122 extends through the rear face 214, the bottom surface 2110 and the lower surface 215. The terminals 22 each have a mounting portion 221 extending downwardly from a rear end thereof.

Figure 3:
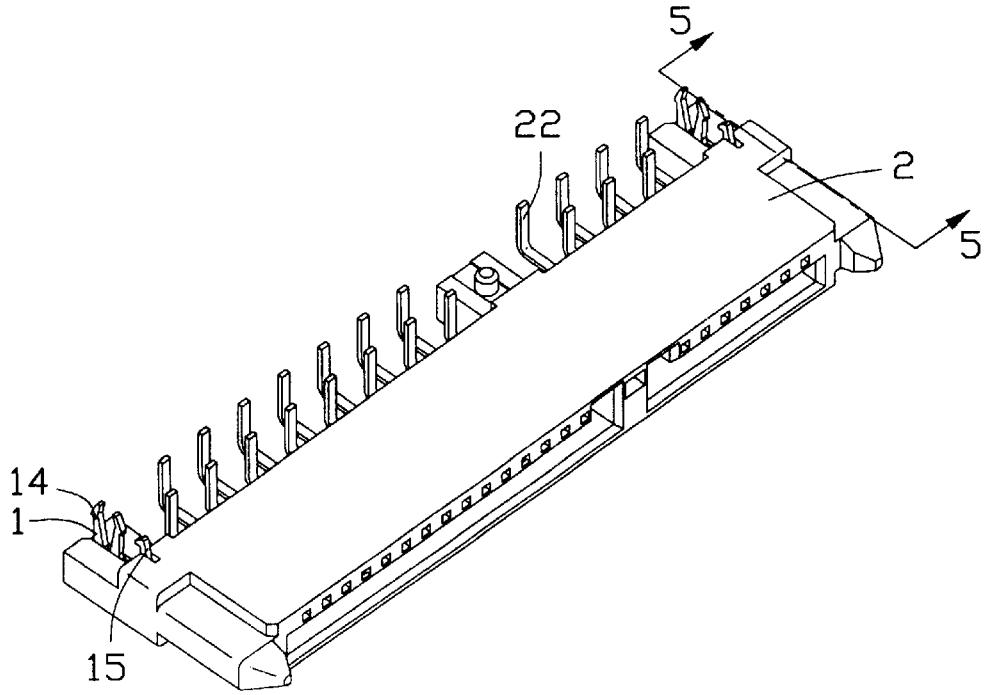
FIG. 3 is an assembled view of the electrical connector shown in FIG. 2 from a different aspect.
Figure 5:
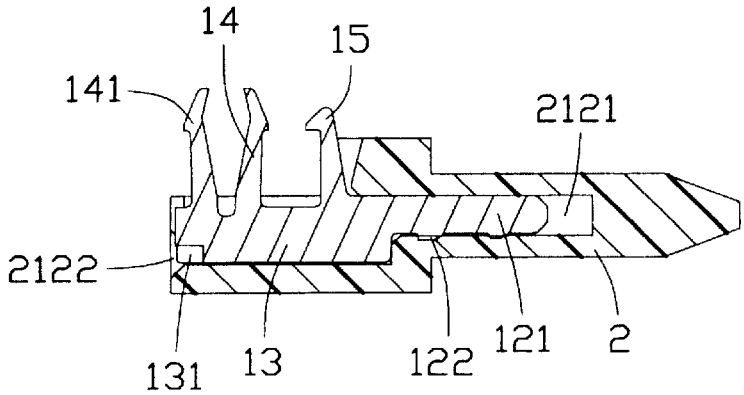
FIG. 5 is a cross-sectional view taken along line 5—5 of FIG. 3.

Referring to FIGS. 3 and 5, when the board lock 1 is assembled to the electrical connector 2, the connector engaging portion 121 is engaged in the first part 2121 of a corresponding slit 212 with the barbs 122 engaging with an upper wall of the first part 2121. The second end 13 is received in the second part 2122 of the corresponding slit 212 with the inclined tab 131 engaging with a side surface of the second part 2122 of the slit 212, thereby preventing the board lock 1 from separating from the electrical connector 2. The legs 14 extend downwardly from the second part 2122 of the slit 212 and through a corresponding cutout 216. The additional beam 15 extends downwardly and through the lower surface 215.

Figure 4:
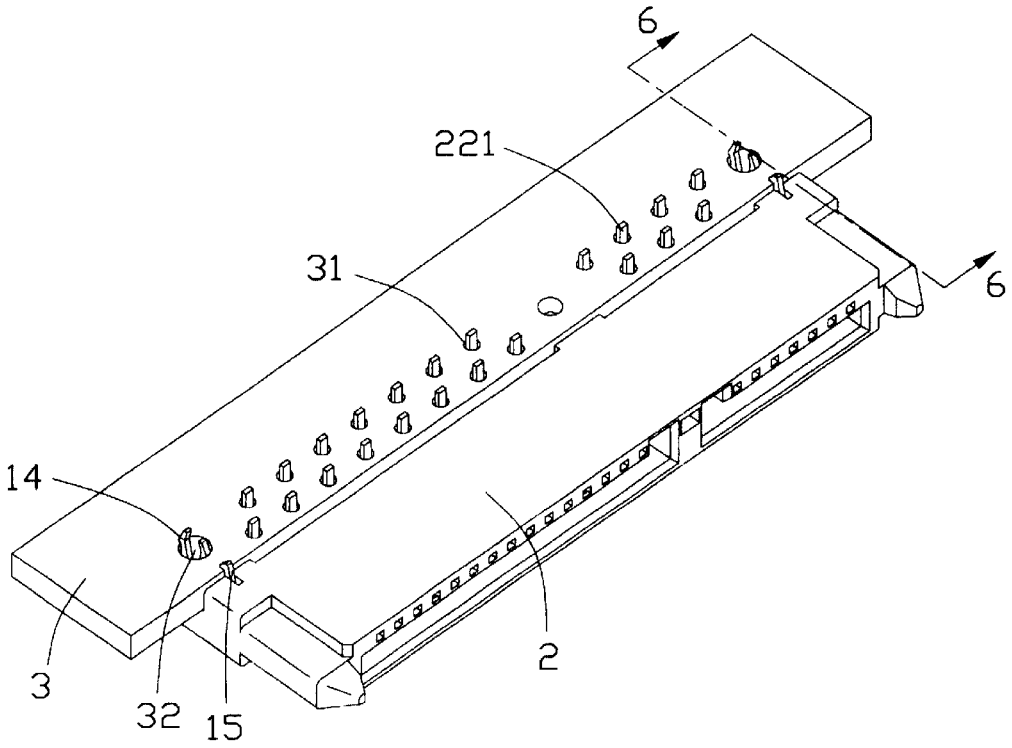
FIG. 4 is a perspective view of the electrical connector shown in FIG. 3 mounted to a PCB.
Figure 6:
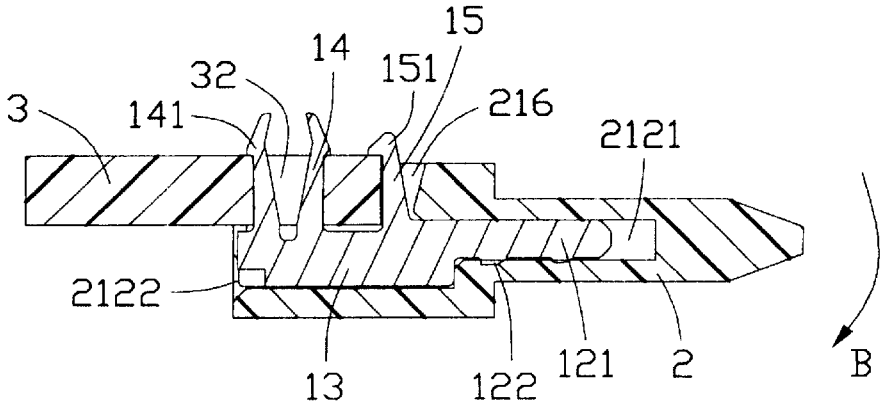
FIG. 6 is a cross-sectional view taken along line 6—6 of FIG. 4.
Figure 7:
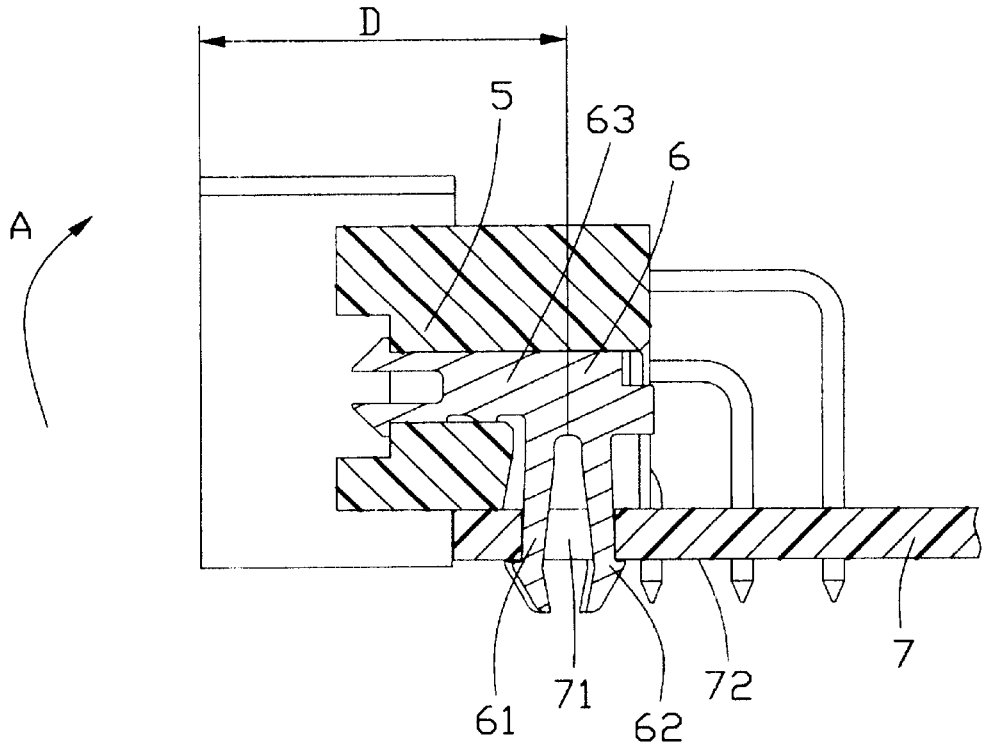
FIG. 7 (RELATED ART)
FIG. 7 is a cross-sectional view of a related board lock connecting an electrical connector and a PCB together.

Referring to FIGS. 4 and 6, the PCB 3 has a plurality of through holes 31 and a pair of slots 32 defined from a bottom surface to an upper face thereof. When it is assembled to the electrical connector 2, the PCB 3 is positioned into the cutouts 216. The mounting portions 221 of the plurality of terminals 22 run downwardly through the through holes 31 and are soldered to the PCB 3 by wave soldering technology. The legs 14 run though the slots 32 with the latch portions 141 abutting against the bottom surface of the PCB 3. The additional beam 15 abuts against a front edge of the PCB 3 with the latch portion 151 abutting against the bottom surface of the PCB 3. Thus, the electrical connector 2 is secured to the PCB 3 by the legs 14 and the additional beam 15. The electrical connector 2 is prevented from rotating in direction B of FIG. 6 when a complementary connector (not shown) is pushed to mate with the electrical connector 2.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A board lock for holding an electrical connector to a printed circuit board, comprising:

a body section having a first end and a second end, said first end having an engaging portion for engaging into the connector, said second end having a pair of legs extending downwardly therefrom and adapted to extend into the printed circuit board, and an additional beam extending downwardly therefrom adapted for abutting against an edge of the printed circuit board, each of said legs having an outer edge and a latch portion extending laterally from the outer edge adapted to latch to a bottom surface of the printed circuit board, the additional beam also having a latch portion extending laterally and adapted to latch the bottom surface of the printed circuit board;

wherein the latch portion of the additional beam extends toward the pair of legs.

2. The board lock as described in claim 1, wherein the connector engaging portion has a barb formed thereon for engaging with the electrical connector.

3. The board lock as described in claim 1, wherein the second end has an inclined tab projecting sideward for engaging with the electrical connector to prevent the board lock from separating from the connector.

4. An electrical connector for mounting to a printed circuit board, comprising:

an insulative housing having a plurality of terminals received therein, the insulative housing defining a slit from a rear face toward a mating face thereof;

a board lock comprising a body section disposed within the slit defined in the housing, the body section comprising a first end and a second end, said first end having a connector engaging portion engaging in the slit, said second end having a pair of legs and an additional beam extending downwardly therefrom beyond a lower surface of the housing, the legs being adapted for extending into the printed circuit board and the additional beam being adapted for abutting against an edge of the printed circuit board, each of said legs having an outer edge and a latch portion extending laterally from the outer edge for latching to a bottom surface of the printed circuit board, the additional beam also having a latch portion extending laterally and adapted for latching the bottom surface of the printed circuit board;

wherein the latch portion of the additional beam extends toward the pair of less.

5. The electrical connector as described in claim 4, wherein the connector engaging portion of the board lock has a barb formed thereon, the barb engaging with an inner surface of the slit of the housing.

6. The electrical connector as described in claim 4, wherein the second end of the board lock has an inclined tab projecting sideward, the tab engaging with an inner surface of the slit of the housing.

7. The electrical connector as described in claim 4, wherein the terminals each have a mounting portion extending downwardly from a rear end thereof for mounting in the circuit board.

8. The electrical connector as described in claim 4, wherein the insulative housing comprises a pair of side sections on opposite sides thereof, the slit being defined in at least one of the side sections.

9. The electrical connector as described in claim 8, wherein the side sections each define a cutout in a rear portion of a lower surface of the housing, each side section forming a bottom surface above the lower surface.

10. The electrical connector as described in claim 9, wherein each side section has a connection surface connecting the lower surface of the housing and the bottom surface of each side section.

11. The electrical connector as described in claim 10, wherein the slit comprises first and second parts, the first part of the slit is defined in an interior of at least one of the side sections and the second part extends through the rear face of the housing and the bottom surface of the at least one of the side sections, the first and second ends of the board lock are respectively received in the first and second parts of the slit.

12. The electrical connector as described in claim 11, wherein the legs and the additional beam extend downwardly from the second part of the slit and through the bottom surface of the least one of the side sections.

* * * * *